United States Patent [19]

Komiyama et al.

[11] 4,261,049

[45] Apr. 7, 1981

[54] WRISTWATCH WITH SOLAR CELLS

[75] Inventors: Katsuhiko Komiyama; Toshio Hiruta, both of Tokyo, Japan

[73] Assignee: Citizen Watch Co., Ltd., Tokyo, Japan

[21] Appl. No.: 969,135

[22] Filed: Dec. 13, 1978

[30] Foreign Application Priority Data

| | | | |
|---|---|---|---|
| Dec. 20, 1977 | [JP] | Japan | 52/171785[U] |
| Dec. 21, 1977 | [JP] | Japan | 52/153712[U] |
| Jan. 9, 1978 | [JP] | Japan | 53/903[U] |

[51] Int. Cl.[3] ..... G04C 23/02; G04B 1/00; G04C 17/00

[52] U.S. Cl. ..... 368/88; 368/205; 368/239

[58] Field of Search ..... 307/64, 65, 66; 58/23 R, 23 C, 88 R

[56] References Cited

U.S. PATENT DOCUMENTS

| | | | |
|---|---|---|---|
| 3,921,049 | 11/1975 | Mellors et al. | 58/23 C |
| 4,019,313 | 4/1977 | Mason et al. | 58/23 R |
| 4,038,104 | 7/1977 | Tsutomu | 58/23 C |
| 4,165,604 | 8/1979 | Matsumura et al. | 58/23 BA |

*Primary Examiner*—Vit W. Miska
*Attorney, Agent, or Firm*—Jordan and Hamburg

[57] ABSTRACT

A wristwatch includes a module, and a display section overlying the module. The module has a recess which surrounds the display section and which accommodates a solar cell unit having a window therein for accommodating the display section. The unit is located by the co-operation of the edge of the window with projecting portions on the module. The upper surfaces of the display section and the solar cell unit are substantially flush. Support members for supporting the display section are electrically connected with a battery of the watch and have spring portions which are electrically connected to the solar cell unit.

23 Claims, 17 Drawing Figures

WRISTWATCH WITH SOLAR CELLS

TECHNICAL FIELD

The present invention relates to the structure of a wristwatch equipped with solar cells.

BACKGROUND ART

Wristwatches driven by small size batteries installed therein have come into wide use as well as quartz timepieces using quartz crystal vibrators as time standards. A drawback inherent in this type of wristwatches resides in that the lifetime of such batteries is not more than 1-2 years requiring frequent replacement of batteries. To cope with this problem, there has been proposed a timepiece furnished with solar cells which convert solar energy into electric energy to charge the battery. Such a timepiece therefore needs no replacement of the battery.

However, a solar powered timepiece generally has an intricate construction because it includes a solar cell unit made up of solar cells, a diode for preventing reverse current, an overcharge preventing resistor, etc., in addition to the various component parts usually installed in a timepiece.

A simpler construction for a solar cell wristwatch may be obtained by forming the solar cells, diode, resistor and like components separately from the conventional movement of a timepiece. This however involves difficulty in the electrical connection between the movement and the solar cell unit, and assemblage thereof.

A further problem is that, among the components of the unit, at least the solar cells must be mounted with high accuracy since they will show themselves through a glass face plate of the timepiece.

Another problem arises from the fact that conventional wristwatches with solar cells may be generally classified into the following two types:

(A) A wristwatch having the solar cell unit positioned on a conventional wristwatch structure.

(B) A wristwatch whose movement has been designed to accommodate the solar cell unit.

The first type (A) of wristwatch is not acceptable from the viewpoint of design because the overall thickness of the solar cell unit and conventional movement is considerable. The second type (B) of wristwatch is effective when used solely as a solar cell wristwatch but has the following drawback where it is intended selectively to serve as solar cell wristwatch or an ordinary wristwatch. As an ordinary wristwatch, the wristwatch (B) has a structure designed to accommodate a solar cell unit, and the absence of the components of the unit results in unnecessary waste space and intricacy of arrangement.

DISCLOSURE OF INVENTION

According to a first aspect of the invention, there is provided a wristwatch having a module, a display section overlying said module, said module having a part which surrounds the display section and is recessed with respect thereto, and a solar cell circuit board carrying solar cells and having a window for accommodating said display section, the circuit board being disposed in said recessed part of said module and located by the co-operation of the edge of the window with said module.

This enables the wristwatch to have a simple structure, and permits the solar cell unit to be mounted accurately.

According to a second aspect of the invention, there is provided a wristwatch having a module, a display section overlying the module, said module having a part which surrounds the display section and is recessed with respect thereto, and a solar cell unit having solar cells and disposed in said recessed part and substantially lying in the same plane with said display section.

Such a wrist watch can be designed with a thin structure, and be suitable both as an ordinary wristwatch, and, with the solar cell unit, as a solar powered wristwatch.

According to a further aspect of the invention, there is provided a wristwatch including a display section, electrically conductive support members for supporting the display section, and a solar cell circuit board having solar cells thereon, the support members being electrically connected with a battery of the watch and having spring portions electrically connected to said circuit board.

This arrangement permits the use of a solar cell unit which is independent of the movement of the timepiece but electrically connected thereto, without requiring any additional parts.

DETAILED DESCRIPTION OF DRAWINGS

Figure 1:
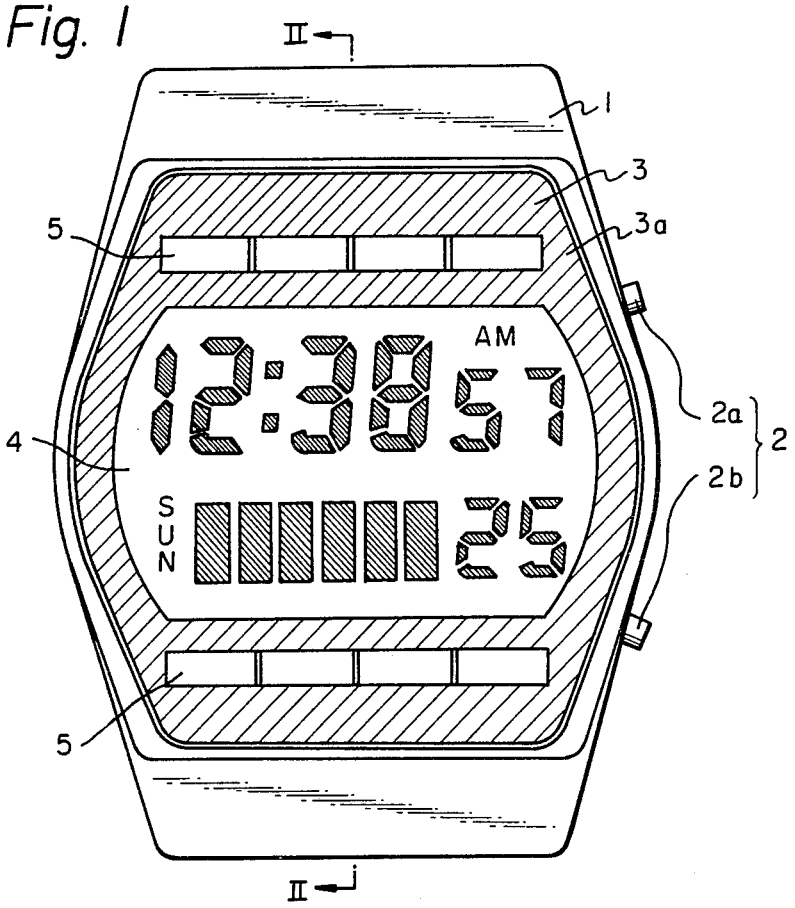
FIG. 1 is a plan view of a wristwatch in accordance with the invention.

Referring to FIG. 1, a wristwatch having solar cells and in accordance with the present invention is illustrated in plan. The timepiece includes a casing 1 and push buttons 2*a* and 2*b* mounted to the casing 1 for the change of display, correction of display, turn-on of a lamp (not shown) and like functions. Reference numeral 3 denotes a face plate of glass rigidly and sealingly connected to the casing 1 and having a colored layer, indicated by the hatched area 3*a* which forms a boundary for a display section 4 and windows for solar cells 5, which will be discussed hereinafter. The display section 4 employs a display element, such as a liquid crystal display, and is shown in the drawing as providing the digital display "25th, Sunday, 12 hours 38 minutes 57 seconds a.m.".

Figure 2:
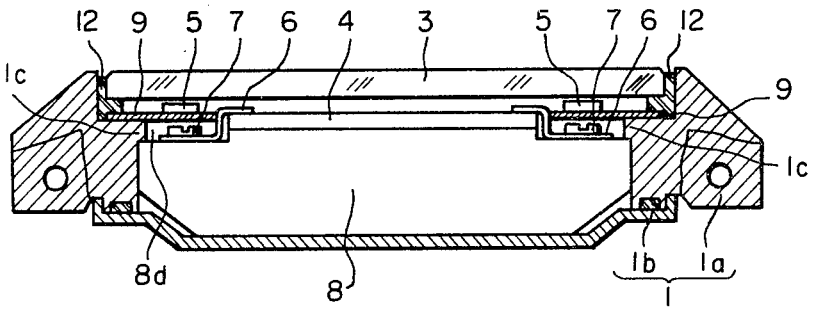
FIG. 2 is a section taken on the line II—II of FIG. 1.

FIG. 2 is a section taken along line II—II of FIG. 1. As shown, the casing 1 of the timepiece comprises a case 1*a* and a back cover 1*b* while the display section 4 is rigidly mounted by metal supports 6 having screws 7 extending therethrough to a module section 8 which includes a battery, an electronic circuit, a capacitor and like parts (not shown) of the timepiece.

Denoted 9 is a circuit board for solar cells which is made of, for example, epoxy resin containing glass therein. The circuit board 9 carries solar cells 5 on its side adjacent to the face plate 3. Mounted on the other side of the circuit board are a reverse current preventing diode 10 and an overcharge preventing resistor 11, as shown in FIG. 3B. These component parts on the circuit board 9 constitute a solar cell unit.

As shown in FIG. 2, the module section 8 has a recess 8*d* surrounding the display section 4. The circuit board 9 is located in the recess 8*d* while being positioned by the peripheral edges of the display section 4. The circuit board is securely mounted by the face plate 3 to a shoulder 1*c* of the base 1*a* by means of a packing 12.

Figure 3A:
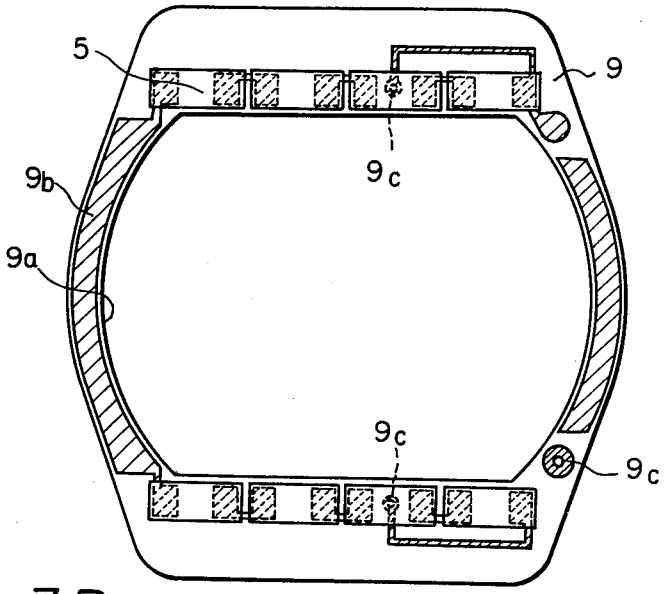
FIG. 3A is a top plan view of a solar cell unit of the watch.
Figure 3B:
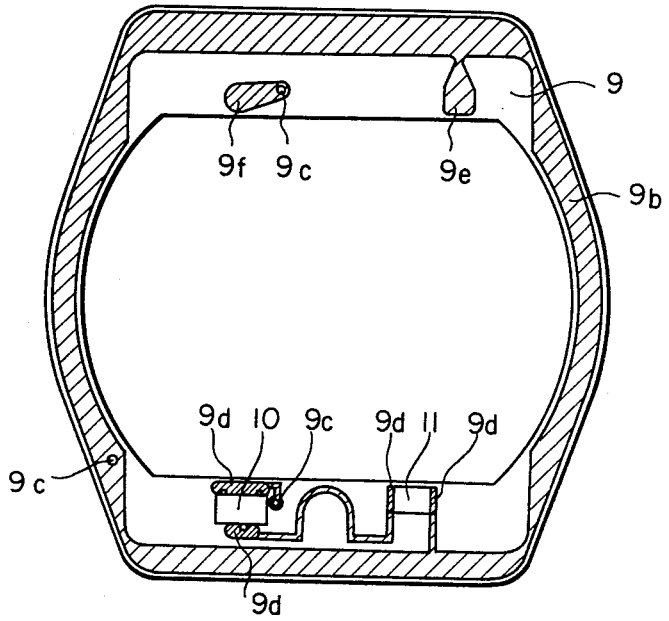
FIG. 3B is a bottom plan view, and FIG. 3C a side elevation.
Figure 3C:
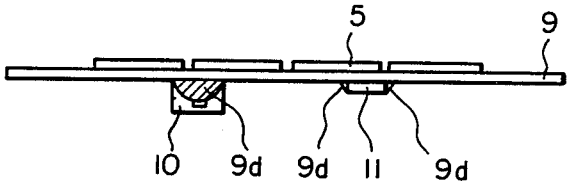

Referring to FIGS. 3A to 3C the circuit board 9 has a window 9*a* for accommodating the display section 4 and whose edges co-operate with those of the display section 4 to position the circuit board. The solar cells 5, of which there are eight in total, are connected in series by a writing pattern 9*b* represented by a hatched area in the drawings. The diode 10 and resistor 11 are welded to the opposite side of the circuit board as at 9*d* and are electrically connected with the solar cells 5 via through-holes 9*c*. Terminals 9*e* and 9*f* associated with the circuit board are electrically connected with positive and negative terminals of a battery installed in the module section 8, by way of coil springs or like conductors (not shown).

Figure 4:
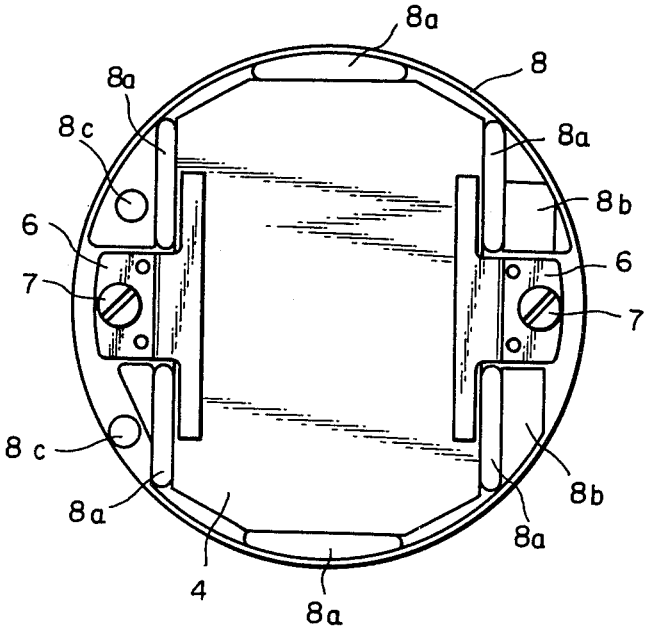
FIG. 4 is a plan view of the movement of the watch.

The module section is illustrated in plan in FIG. 4. The module section includes, around the display section 4, lugs 8*a* for positioning the display section 4, notches 8*b* for accommodating the diode 10 and resistor 11 and holes 8*c* in which members for establishing electric connection between the module section 8 and circuit board 9 are received.

The lugs 8*a* position the display section 4 with their inner surfaces or peripheries and the circuit board 9 with their outer peripheries engaged with the edges of the window 9*a*.

As has thus far been described, a wristwatch according to the present invention has a circuit board having at least solar cells thereon placed in a recessed portion of a module section surrounding a display section and positioned by projections of the module section. Accordingly, the circuit board can be positioned readily, without resort to any further positioning means, rendering the construction of the timepiece simple. Also, the solar cell unit can be positioned with accuracy because it is located by the module section.

Additionally, as the circuit board is substantially lying in the same plane with the display section, the overall thickness of the wristwatch is reduced.

Figure 5:
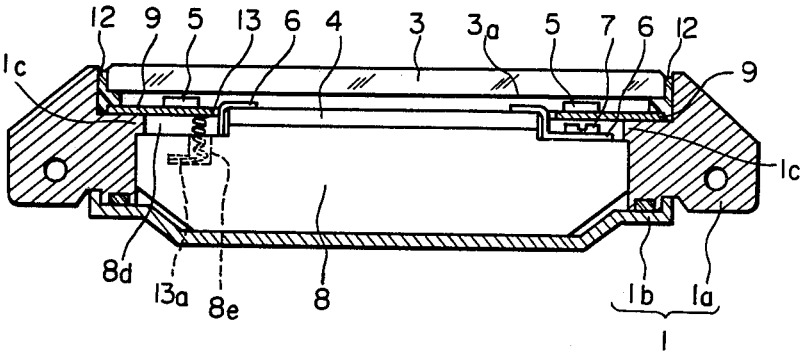
FIG. 5 is a section showing a modified version of the watch shown in FIG. 1.
Figure 6A:
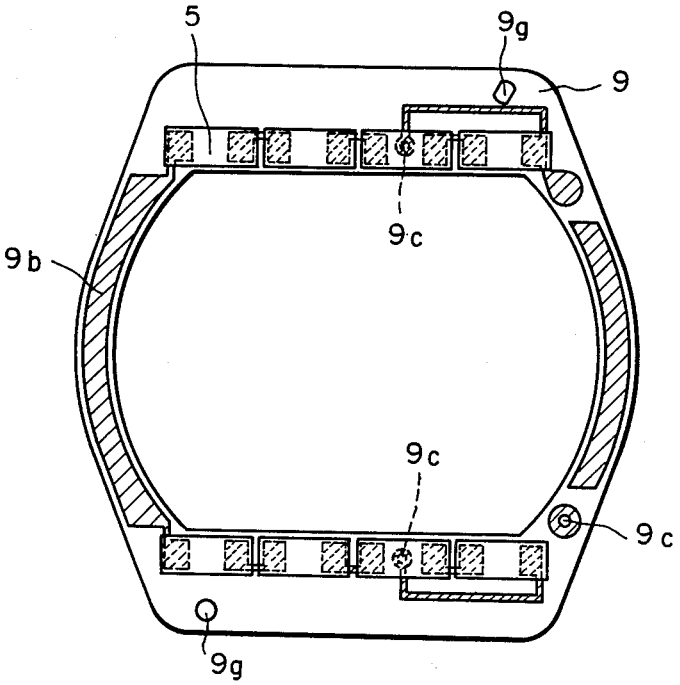
FIGS. 6A to 6C are views similar to those of FIGS. 3A to 3C, showing the solar cell unit of the modified version.
Figure 6B:
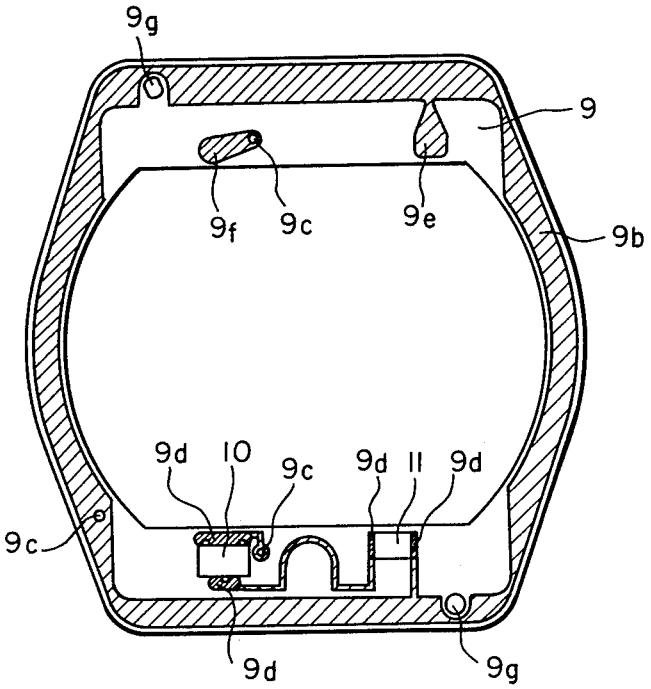
Figure 6C:
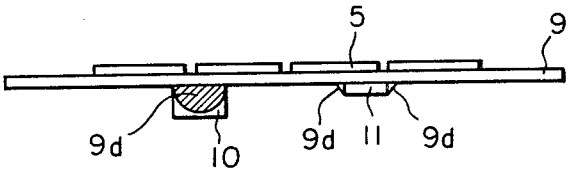
Figure 7:
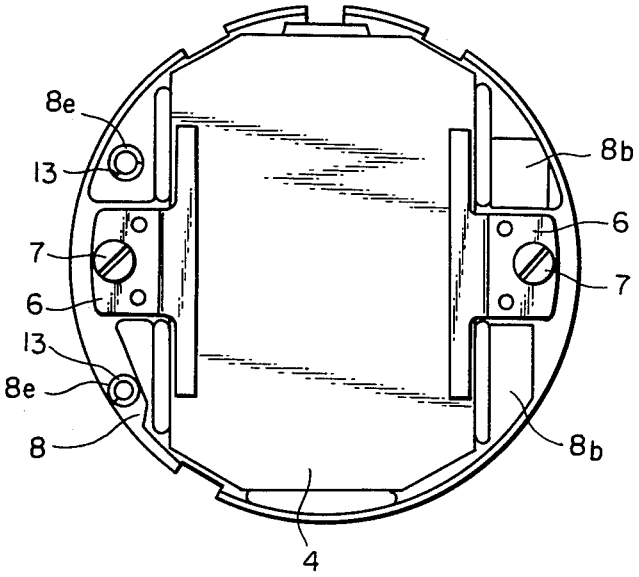
FIG. 7 is a view similar to that of FIG. 4 showing the movement of the modified version.

A modified version of the timepiece is shown in FIGS. 5 to 7, in which like parts are given like reference numerals. In this version, the solar cells 5 are electrically connected with a battery (not shown) in the module section 8 by coil springs 13 which are partly received in corresponding bores 8*e*. Each coil spring 13 has an extension 13*a* to be thereby positioned stably within the corresponding bore 8*e*.

The circuit board 9 is electrically connected with the positive and negative terminals of the battery installed in the module section 8, by way of the coil springs 13, by means of the terminals 9*e* and 9*f* (FIG. 6B).

In this version, two holes 9*g* may also be provided in the circuit board 9 for positioning purposes.

The module section is illustrated in plan in FIG. 7. The module section 8 again includes notches 8*b* for accommodating the diode 10 and resistor 11, as well as the bores 8*e* for receiving the coil springs 13. The solar cell unit of this embodiment is again formed separately from the movement and again disposed in a recess of the movement surrounding a display section, substantially in lying in the same plane with the display section. Thus, there is provided a thin structure for a wristwatch with solar cells. Also, the movement is readily usable both in an ordinary timepiece and a wristwatch with solar cells. Another advantage resides in the simplification of the timepiece structure which facilitates easy replacement of component parts and cut-down of cost.

Figure 8:
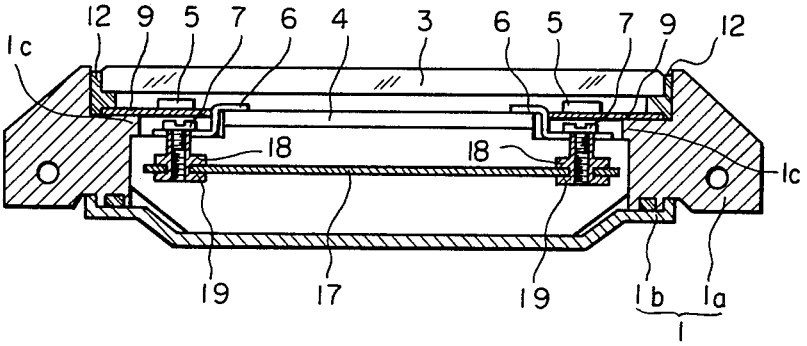
FIG. 8 is a view similar to that of FIG. 2 showing another modified version of the watch.
Figure 9A:
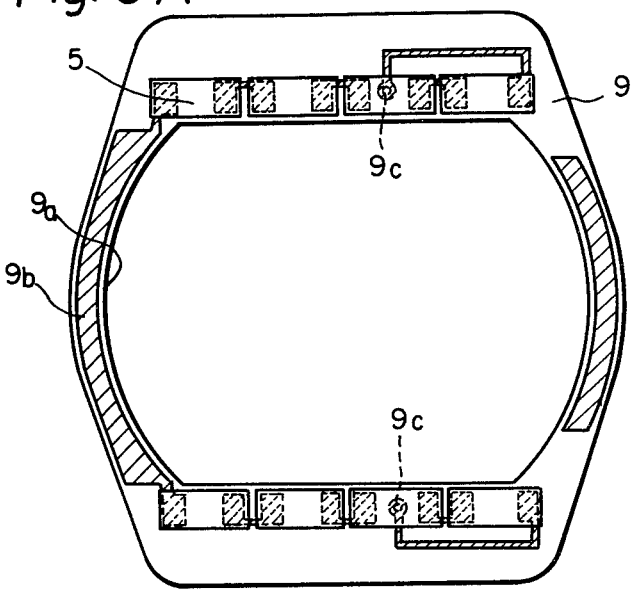
FIGS. 9A to 9C are views similar to those of FIGS. 3A to 3C, showing the solar cell unit of the second modified version.
Figure 9B:
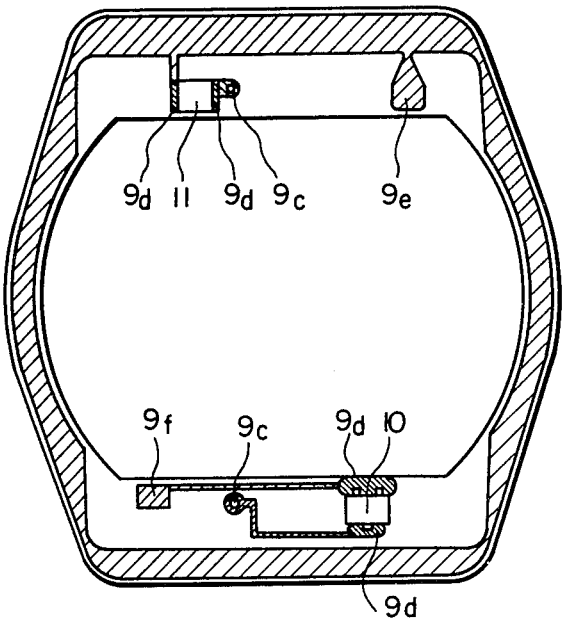
Figure 9C:
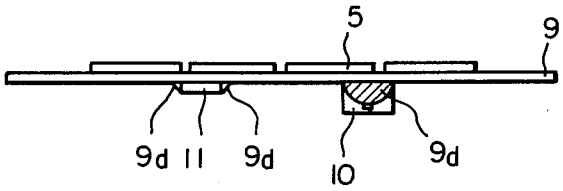

FIGS. 8 to 10 show another modified version of the wristwatch. FIG. 8 shows a timepiece circuit board 17 carrying an IC chip, a capacitor and other electronic parts (not shown) while tubes 18 are fixed in place by seats 19. The tubes 18 are connected electrically with the positive and negative terminals of a battery (not shown), respectively, which are wired on the circuit board 17. The support members 6 are securely mounted to the tubes 18 by means of the screws 7.

As shown in FIGS. 9A and 9B, the wiring pattern 9*b* and the positioning of the diode 10 and resistor 11 differ from the previous embodiments. In this version the terminals 9*e* and 9*f* are engageable with spring portions 6*a* (see FIGS. 10A and 10B of the support members 6.

Figure 10A:
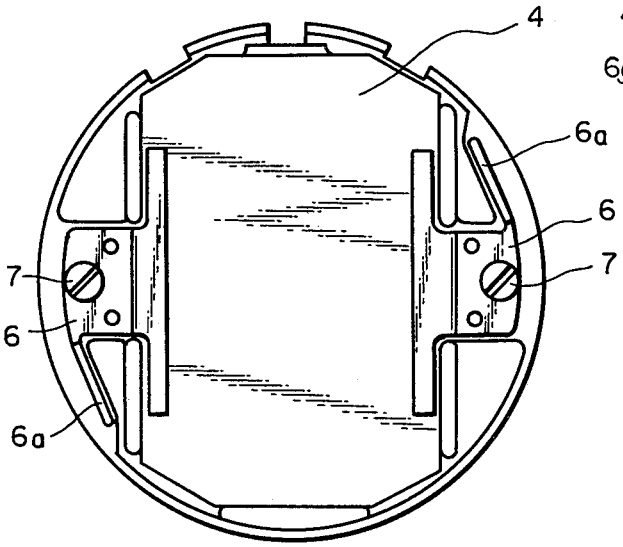
FIG. 10A is a view similar to that of FIG. 4 showing the movement of the second modified version.
Figure 10B:
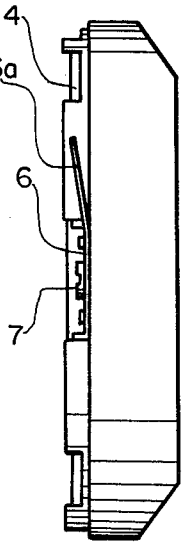
FIG. 10B is a side elevation of the movement.

The movement of the timepiece is shown in plan in FIG. 10A and in side elevation in FIG. 10B. The support members 6 have the spring portions 6*a* bent upwardly into contact with the corresponding terminals 9*e* and 9*f* of the solar cell circuit board 9. Thus, the solar cell unit is electrically connected with the movement via timepiece circuit board 17 and tubes 18.

If course, if desired, the module 8 of the embodiments described above could be used in this embodiment also.

It will now be appreciated from the foregoing that according to the present embodiment a simple wristwatch with solar cells is provided by establishing electrical connection between a timepiece movement and a solar cell unit independent of the movement by means of support members associated with a display section.

We claim:

1. A wristwatch powered by a battery and having a case, a face plate fixedly secured to said case, a module mounted in said case, and a display section disposed on said module and operatively associated with said module to display the time, the improvement comprising:

said case having a shoulder portion formed in a predetermined part thereof and extending in a radial direction of said case;

said module having a recessed part formed at an area between said display section and an inner periphery of said case;

a solar cell circuit board carrying solar cells for providing power for said watch and disposed in said recessed part of said module, and securely mounted to said shoulder portion of said case; and means defining a window in said circuit board for accommodating said display section.

2. A wristwatch as claimed in claim 1, further comprising a packing, and wherein said circuit board is securely mounted by said face plate to said shoulder portion of said case by means of said packing.

3. A wristwatch as claimed in claim 1, wherein said circuit board is located by the co-operation of edges of said window defining means with those of said module.

4. A wristwatch as claimed in claim 1, wherein said circuit board and said display section each have an upper surface, said upper surfaces substantially lying in same plane.

5. A wristwatch as claimed in claim 1, wherein said module includes upstanding lugs disposed around said display section for co-operation with said edges of said window.

6. A wristwatch as claimed in claim 5, wherein said display section is located by the co-operation thereof with said lugs.

7. A wristwatch as claimed in claim 1, wherein said solar cell circuit board carries an overcharge preventing resistor and a reverse current preventing diode.

8. A wristwatch as claimed in claim 7, wherein said module includes notches for accommodating said diode and said resistor.

9. A wristwatch as claimed in claim 1, further comprising electrically conductive support members for supporting said display section, said support members being electrically connected with said battery and having spring portions electrically connected to said circuit board.

10. A wristwatch powered by a battery, comprising:

a case having a shoulder portion extending in a radial direction in a predetermined portion thereof;

a face plate fixedly secured to said shoulder portion of said case;

a module section mounted in said case and having a recessed part;

a display section disposed on said module section and operatively associated with said module section to display the time; and a solar cell circuit board disposed in said recessed part of said module section and securely mounted to said shoulder portion of said case;

said circuit board carrying solar cells for providing power for said watch and having a window to accommodate said display section such that an upper surface of said display section lies in same plane with said circuit board;

said recessed part being formed between said display section and an inner periphery of said case;

said face plate having a colored layer forming a boundary for said display section and windows for said solar cells.

11. A wristwatch as claimed in claim 10, further comprising a resilient packing, and wherein said circuit board is securely mounted by said face plate to said shoulder portion of said case by means of said resilient packing.

12. A wristwatch as claimed in claim 10, wherein said module section includes lugs around said display section to position said display section.

13. A wristwatch as claimed in claim 12, wherein said module includes notches for accommodating an overcharge preventing resistor and a reverse current preventing diode.

14. A wristwatch as claimed in claim 10, further comprising electrically conductive support members for supporting said display section, said support members being electrically connected with said battery, and having spring portions electrically connected to said circuit boad.

15. In a wristwatch powered by a battery and having a case, a face plate fixedly secured to said case, a module mounted in said case, and a display section disposed on said module, said module being operatively associated with said display section for causing said display section to display the time, the improvement comprising:

said module having a recessed portion formed around an outer periphery of said display section;

a circuit board having one side carrying solar cells for providing power for said wristwatch and the other side carrying an overcharge preventing resistor and a reverse current preventing diode, said circuit board being disposed in said recessed portion of said module;

means defining a window in said circuit board for accommodating therein said display section;

said module including upstanding lugs formed around said display section; and said circuit board being located by the co-operation of said window defining means with said upstanding lugs.

16. A wristwatch as claimed in claim 15, wherein said circuit board and said display section each have an upper surface, said upper surfaces substantially lying in same plane.

17. A wristwatch as claimed in claim 15, wherein said display section is located by the co-operation thereof with said lugs.

18. A wristwatch as claimed in claim 15, further including means defining notches in said module for accommodating said diode and said resistor.

19. A wristwatch as claimed in claim 15, further comprising electrically conductive support members for supporting said display section, said support members being electrically connected with said battery, and having spring portions electrically connected to said circuit board.

20. A wristwatch as claimed in claim 15, wherein said lugs have their inner surfaces engaging said display section and their outer peripheries engaging edges of the window.

21. A wristwatch as claimed in claim 15, wherein said circuit board has a couple of terminals formed on the other side of said circuit board for electrically connecting said circuit board with said battery in said module.

22. A wristwatch as claimed in claim 21, wherein said wristwatch further comprises a couple of coil springs being electrically connected with said coupled of terminals, said couple of coil springs being partly received in bores of said module.

23. A wristwatch as claimed in claim 22, wherein each of said coil springs has an extension by which said coil spring is positioned stably within said corresponding bore.

* * * * *